US009999897B2

(12) United States Patent
Denissov

(10) Patent No.: US 9,999,897 B2
(45) Date of Patent: Jun. 19, 2018

(54) PAINT ROLLER

(71) Applicant: Evgueni Denissov, Ontario (CA)

(72) Inventor: Evgueni Denissov, Ontario (CA)

( * ) Notice: Subject to any disclaimer, the term of this patent is extended or adjusted under 35 U.S.C. 154(b) by 203 days.

(21) Appl. No.: 13/904,105

(22) Filed: May 29, 2013

(65) Prior Publication Data

US 2014/0289981 A1 Oct. 2, 2014

(30) Foreign Application Priority Data

Mar. 27, 2013 (CA) ..... 2810808

(51) Int. Cl.
*B05C 17/02* (2006.01)

(52) U.S. Cl.
CPC ..... *B05C 17/02* (2013.01); *B05C 17/022* (2013.01); *B05C 17/0227* (2013.01); *B05C 17/0245* (2013.01)

(58) Field of Classification Search
CPC ..... B05C 17/02; B05C 17/00; B05C 17/0217; B05C 17/0225; B05C 17/0242; B05C 11/025; B05C 1/00; B05C 17/021; B05C 17/0227
USPC ..... 15/118, 230.11
See application file for complete search history.

(56) References Cited

U.S. PATENT DOCUMENTS 2,035,127 A * 3/1936 Hinton ..... 101/329
2,763,022 A 9/1956 Glacken
2,837,757 A 6/1958 Katanich
2,936,474 A 5/1960 Custer
3,213,477 A 10/1965 Shafer
3,623,180 A 11/1971 Anderson
3,685,084 A 8/1972 Bennett
3,986,226 A * 10/1976 Roe ..... B05C 17/0217 15/230.11
4,000,537 A * 1/1977 Woo ..... B05C 17/023 15/144.3
4,350,284 A * 9/1982 Rosemeier ..... B04B 11/06 422/561
5,444,891 A 8/1995 Benson
6,871,376 B1 * 3/2005 D'Ambrosio ..... B05C 17/02 15/230.11
6,877,925 B2 4/2005 Fernandez
2002/0073500 A1 * 6/2002 Pavlou ..... B05C 17/02 15/230.11
2002/0138935 A1 * 10/2002 Lanz ..... 15/230.11
2003/0126711 A1 * 7/2003 Korenevsky ..... B05C 17/0205 15/230.11

* cited by examiner

*Primary Examiner* — Christopher M Koehler
*Assistant Examiner* — Stephanie Berry

(57) ABSTRACT

Disclosed is a paint roller device comprising an inner hub and an outer hub spaced by a cage of wires and adapted for supporting a paint roll sleeve. A cylindrical retainer extends axially outwardly from the outer hub and is adapted to retain a ball therein, the cylindrical retainer being spaced radially inwardly from the periphery of the outer hub to define a gap between an inside surface of the paint roll sleeve when on the roller. The end of the paint roll sleeve on the paint roller device and an end of the retainer define a plane perpendicular to an axis of the roller, and at least a portion of the ball extends a predetermined distance axially outwardly from the plane. The gap between the sleeve and the cylindrical extension prevents paint from interfering with the ball.

18 Claims, 5 Drawing Sheets

PAINT ROLLER

Applicant claims convention priority to the Canadian application filed Mar. 27, 2013, Canadian Patent File No. 2,810,808.

FIELD OF THE INVENTION

The invention relates to a paint roller and more particularly to a paint roller having guide means to guide the roller along a surface so a clean line is provided at the edge of another surface.

BACKGROUND OF THE INVENTION

Paint rollers have been known for years and are acknowledged to speed up the painting of large surfaces as well as providing a good finish; better than a brush or a paint pad may do. When it comes to painting on one surface close to an adjoining surface at an angle to the surface being painted, the ability to paint close to the adjoining surface without paint getting on the adjacent surface has resulted in paint rollers or pads being modified in order to provide a clean line of the painting surface to the adjacent surface without paint impacting on the adjacent surface.

U.S. Patent Publication 2002/0073500 A1 published Jun. 20, 2002 of Pavlou discloses a paint roller providing a guide means for attachment to the cap of the free end of the roller distant from the handle. The guide means has a first closed end and a second end, attached to the distal end of the paint roller. The closed end has one or more apertures and spring biased bearing means mounted on the guide means wherein the bearing means project through the aperture(s) to guide the paint roller along the adjacent surface close to the junction of the two surfaces. The roller is designed and configured so that the sleeve extends along the roller right to the closed end and paint on the sleeve at the end can move across the face of the closed end unless extreme caution is taken. Further, with the spring biased guide means, the user of the paint roller must be careful not to exert too much sideways pressure on the paint roller or else the bias of the spring is overcome, the ball bearing depresses and the clean line of paint intended will be lost. This is particularly the case when one is painting a ceiling or wall overhead with an extended handle.

Accordingly, the Pavlou device requires careful concentration to be sure that the pressure applied to the paint roller when adjacent the second wall or the like does not overcome the spring bias, particularly if paint on the roller has leaked across the closed end.

SUMMARY OF THE INVENTION

An aspect of the invention provides for a paint roller device having an inner hub and an outer hub spaced by a cage of wires and adapted for supporting a paint roller sleeve. A handle is associated with and extends from the inner hub.

A cylindrical retainer extends axially outwardly from the outer hub and is adapted to retain a ball therein. The retainer is spaced inwardly from the inside of a paint sleeve when the sleeve is on the roller device, the end of the paint sleeve on the roller device defining a plane perpendicular to an axis of the roller. At least a portion of the ball extends a predetermined distance outwardly from the plane.

In a preferred aspect, the distance of the ball outwardly of the plane can be adjusted relative to the plane of the roll.

The outer end of the cylindrical retainer for the ball has a flange to rotatably retain the ball therein, the retainer and flange being preferably of plastic.

Another embodiment of the invention provides for a dual paint roller device wherein there are two paint rollers supported in laterally spaced position, at least one roller is configured as set forth above. Preferably both paint rollers are of similar configuration each with means to adjust the outward distance of the ball relative to the plane of the two sleeves when on the rollers.

The invention also comprehends a paint roller accessory comprising a plate adapted to be connected to an outer end of a paint roller outer hub. A cylindrical retainer extends outwardly from the plate, the cylindrical retainer having an inwardly flanged end adapted to hold a ball therein. The diameter of the retainer is less than the diameter of the plate. The accessory can be configured to be attached to the end of the outer hub by screws or like fasteners, or as an alternative, by a thin cage of flexible arms of plastic material extending rearwardly over the periphery of the outer hub.

- The design of the roller with the ball allows for a small space between the wall and the ceiling or adjacent wall, thus allowing for an even line while painting.
- The spacing or outward extension of the ball can be adjusted from 2 mm to 6 mm with the special mechanism within the paint roller.
- The gap between the location of the ball and end of the sleeve prevents paint from interfering with the ball.
- The construction of the dual paint roller allows painting of wall surfaces as high as 5 meters without the use of ladders and scaffolds.
- There is no more need to use painter's tape, thus eliminating or minimizing the prep time.
- Due to the originality of the construction, productivity can be increased by 2-3 times between the start and completion of the job.
- The paint roller allows for easier painting of hard to reach and awkward spaces such as stair case areas without having to use scaffolding.
- The paint roller is simple to use regardless of whether you are a professional painter or someone who has no experience at all. The design allows for a professional looking finish no matter who does it.
- The paint roller of my invention is distinct from tools used for "edging" in that the tool in one embodiment consists of two paint rollers to roll the paint on the wall unlike competitor products which all use paint pads and drag the paint across the surface. My method distributes the paint more even and much easier leaving the painted surface looking professional and finished in half the time.

The invention will be more fully appreciated and understood from the detailed description which follows.

DETAILED DESCRIPTION OF THE PREFERRED EMBODIMENTS

Figure 1:
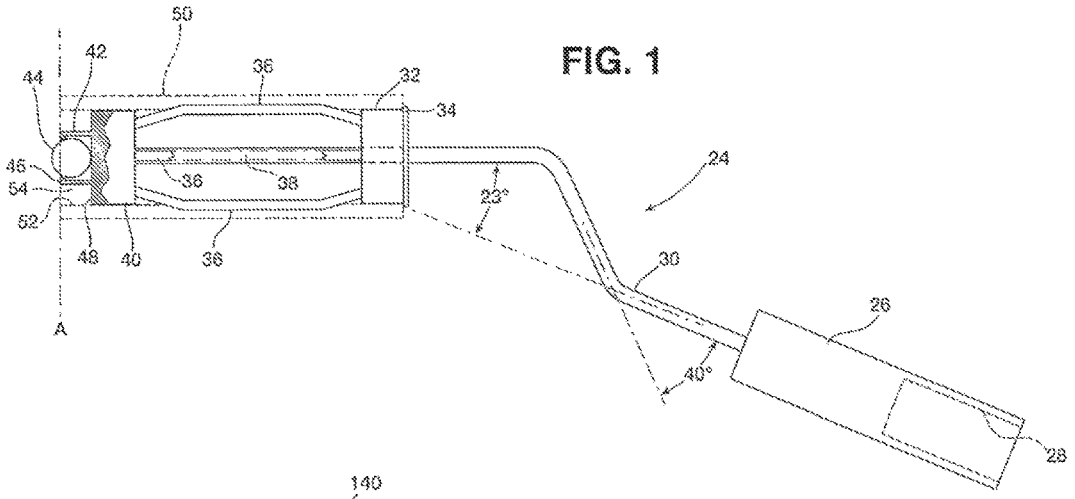
FIG. 1 is a side view of an embodiment of the invention.

Turning to FIG. 1, a first embodiment of the invention illustrates a paint roller device 24 with handle 26 with internal threaded recess 28 for a threaded extension (not shown). Although wire support 30 is shown with angled sections, the angles of the sections are for convenience and form no significant part to the invention. Rotatably connected with wire support 30 is inner hub 32 with flange 34, against which a paint roller sleeve would abut in use. Extending from inner hub 32 is a sleeve support cage of wires 36, four circumferentially spaced about a center rod 38. Roller sleeve support wires 36 and rod 38 are connected to distal or outer end hub 40 which has a cylindrical retainer 42 extending outwardly from hub 40 for ball 44. Ball 44 is held within retainer 42 by rim flange 46, the ball 44 being pressed into the retainer and held therein so as to be able to rotate when contacting a surface.

Hubs 32 and 40 are of plastic and flanged retainer section 42 is also of plastic into which ball 44 can be pushed and is retained by circular flange 46. Ball 44 is held between flange 46 and the outer end 48 of hub 40 such that it can rotate freely. The ball is preferably a glass ball.

FIG. 1 also shows in dotted lines a sleeve 50 on the device 24 (without the wires 36 flexed inwardly) and it will be apparent that the distal end 52 of the sleeve 50 extends beyond hub 40 and ends in line with the end of flanged retainer 42. The end of the sleeve defines a plane perpendicular to the axis of the sleeve. A cylindrical gap 54 is created between cylindrical retainer 42 and the inside of sleeve 50 and the outer periphery of hub 40. The cylindrical gap 54 is an open annulus around the cylindrical retainer. Accordingly, paint cannot creep across the face of the roller device to interfere with the operation of the ball 44.

Figure 5:
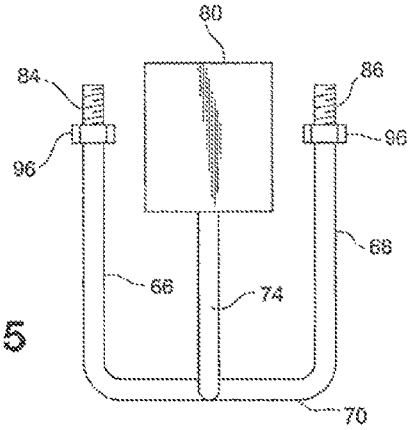
FIG. 5 is a front view of the paint roller support bracket of the FIG. 2 embodiment.
Figure 7:
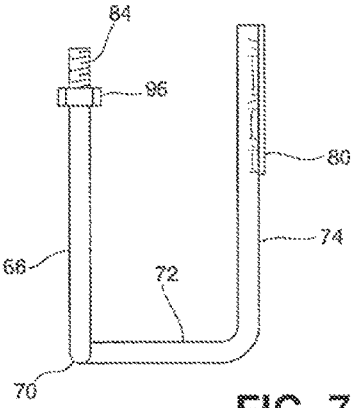
FIG. 7 is a side view of the roller support bracket of FIG. 5.
Figure 6:
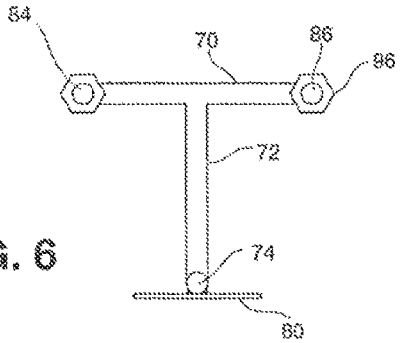
FIG. 6 is a top view of the roller support bracket of FIG. 5.
Figure 8:
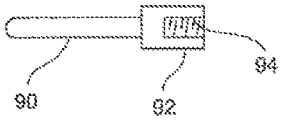
FIG. 8 is a side view of an adjustable extension for the roller support for contacting the ball.
Figure 9:
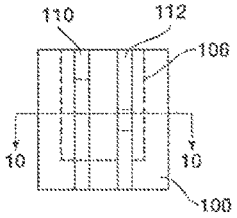
FIG. 9 is a front view of a handle support bracket associated with the handle of the FIG. 2 embodiment.

Turning now to the FIG. 2 embodiment, there is shown a dual paint roller device 60 having two rollers 62, 64, at least one, and preferably both of similar construction to that of FIG. 1 with the exception of the center rods 66 and 68 (rod 68 not shown in FIG. 2) as further described below. The features of the rollers that are the same as those in FIG. 1 have similar reference numbers with the "a" designation. Roller support bracket 70 includes rods 66 and 68 and bracket 70 is connected to rod 72 which is in turn connected to support bracket rod 74 which is parallel to rods 66, 68. FIGS. 5-7 illustrate more fully the roller support bracket 70 and includes rectangular plate 80 attached to support bracket rod 74. The upper ends 84 and 86 of rods 66 and 68 are exteriorly threaded and extension 90, only one being shown in FIG. 8, has hub 92 with threaded recess 94 for an adjustably threaded connection with ends 84 and 86 of rods 66, 68 thus providing adjustment means for the balls 44*a* relative to the ends 48*a* of the hubs 40*a*. Nut 96 on rods 66, 68 are lock nuts for locking, with hub 92, the position of extension 90.

Figure 11:
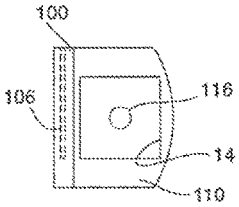
FIG. 11 is a side view of a support bracket of FIG. 9.
Figure 12:
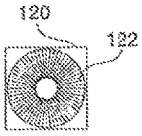
FIG. 12 is a front view of the ratchet insert for the support bracket of FIG. 9.
Figure 13:
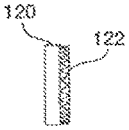
FIG. 13 is a side view of the ratchet insert of FIG. 12.
Figure 10:
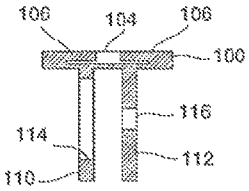
FIG. 10 is a top view partly in section along line 10-10 of FIG. 9 of the support bracket of FIG. 9.
Figure 14:
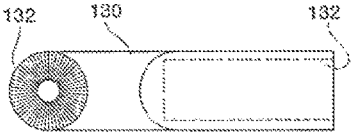
FIG. 14 is a side view of the handle support bracket.
Figure 15:
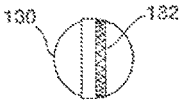
FIG. 15 is an end view of the handle support bracket of FIG. 14.

Turning to FIGS. 9 to 13, the handle bracket 100 is adapted to connect with roller bracket plate 80. Plate 80 is slotted at 104 with internal recesses 106 such that roller bracket plate 80 and upper portion of rod 74 will fit within the recesses 104 and slot 106. Handle bracket 100 has two rearwardly extending plates 110, 112, plate 110 having a rectangular aperture 114 therein as shown in FIGS. 10 and 11 and plate 112 has a circular aperture 116. FIGS. 12 and 13 illustrate rectangular ratchet plate 120 which fits within recess 114 of plate 110 and provides ratchet disc 122 on one face. Handle 130 has a ratchet disc 132 which cooperates with ratchet disc 116 and provides for selected adjustment of the handle 130 relative to the position of the rollers, handle 130 having an internally threaded bore 132 for coupling an extension (not shown) thereto.

Figure 16:
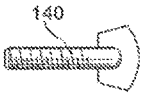
FIG. 16 is a side view of a fastener bolt for securing the handle bracket to the roller support bracket.
Figure 17:
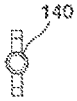
FIG. 17 is an end view of the fastener screw of FIG. 16.

The threaded winged fastener 140 shown in FIGS. 16 and 17 in conjunction with a nut 142 (FIG. 2) secures the handle 130 to bracket 100 and permits selected rotation of the handle 130 relative to the rollers 62, 64.

Although the embodiment of FIG. 1 does not show an adjustable center rod, it will be appreciated that the single roller embodiment may equally have a mechanism to adjust the location of the ball relative to the plane defined by the circular end of the sleeve roller extending outwardly from hub 40.

An exemplary paint roller I have used has a length of about 100 mm from the inside of the flange 34 of inner hub 32 to the outer surface 48 of outer hub 40, with both hubs having a diameter of 35 mm and an axial length of 15 mm. The cylindrical extension 42 has an axial length of 27.5 mm and a diameter of 19 mm. The flanged opening 46 has a diameter of 14 mm with the glass ball a diameter of 16 mm. The depth of the interior of cylindrical extension 42 for the ball in FIG. 1 for example, is 17.5 mm. The length of the paint sleeve is 127 mm and is preferably a high density foam sleeve rather than a nap roller found in the art, although the latter will work effectively.

Although not essential, the preferred angular relationship of handle 26 relative to the axis of the rod 38 is shown in FIG. 1.

The preferred ball is a glass ball as it will not mark the surfaces in which it engages as much as metal balls. However, the device will also work with metal balls or plastic balls.

Figure 18:
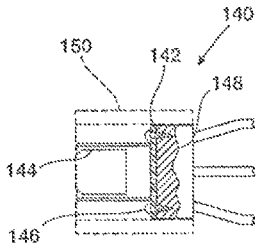
FIG. 18 is a partly sectional view of an accessory embodiment which can be attached to existing rollers (appears with FIG. 1)
Figure 19:
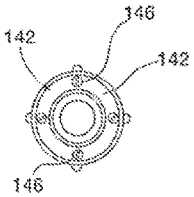
FIG. 19 is an end view of the embodiment of FIG. 18 (appears with FIG. 1)

FIGS. 18 and 19 illustrate an attachment or accessory for an existing paint roller.

FIGS. 18 and 19 illustrate an attachment or accessory device 140 comprising a plate 142 from which cylindrical ball retainer 144 extends. Plate 142 has apertures through which screws 146 or like fastener means can secure plate 142 to outer hub 148 of an existing paint roller.

Attachment 140 can be sold separately with small screws in a kit with simple instructions to drill small holes in the end of the plastic hub 148, if necessary. The attachment of accessory 140 to the hub is made prior to the insertion of the hub into a paint roller sleeve 150.

Figure 20:
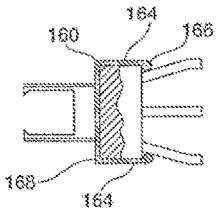
FIG. 20 is another embodiment of the accessory device in side view (appears with FIG. 1).

The embodiment of FIG. 20 shows a further embodiment of the accessory with plate 160 having three thin rearwardly extending flexible arms 164 with a slightly bulbous ends 166 to the arms. The plate 160 is fitted to the outer hub 16 with arms 164 flexed outwardly over the periphery of the hub. The bulbous ends 166 are directed inwardly when the arms have moved over the hub. When a sleeve is forced over the outer hub the arms of the plate is held against the hub by the friction between the arms 164 and sleeve. The bulbous ends 166 resist the plate being forced away from the hub when the sleeve is removed from the roller.

In Summary;

To avoid paint spilling over the end of the roller onto the ball during painting, the construction of the roller has two safeguards:

1) The ball sits inserted in a special cylinder retainer extending from the outer hub; and 2) The roller sleeve fits over the roller cage and the outer end of the roller sleeve is on the same level or plane as the top of the cylinder retainer (which houses the ball). This allows for any paint to safely spill over into the created gap or reservoir or open annulus around the cylindrical retainer allowing for a clean line finish.

To assure a quality finish and a clean line when painting at a 90° angle, it is most preferred to use a high density foam roller sleeve, especially while painting at a height (up to 5 m) using the dual roller embodiment which requires the use of an extension pole. However, a regular yellow foam sleeve may also be used at lower levels.

The advantage of this invention, as well as the timing in which it takes to finish a job from beginning to end, has been verified by myself with a prototype that I made. I have successfully painted a wall with a dual roller system that was 4.5 meters high in a stairwell and it did not require any prep work such as taping.

Figure 2:
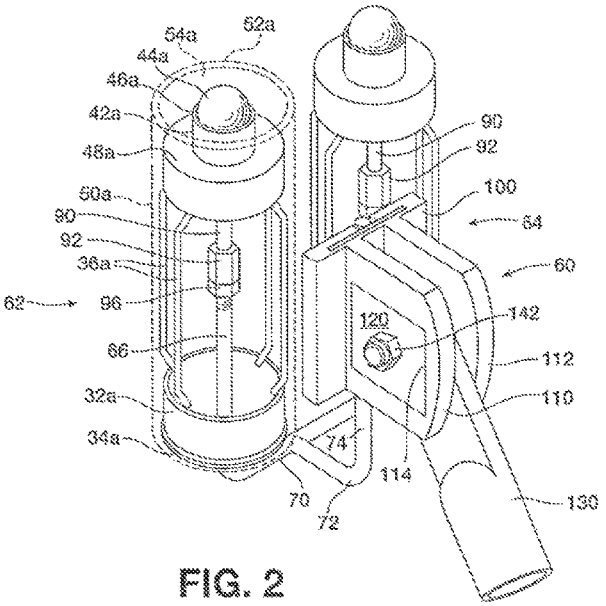
FIG. 2 is a perspective view of a second embodiment of the invention.
Figure 3:
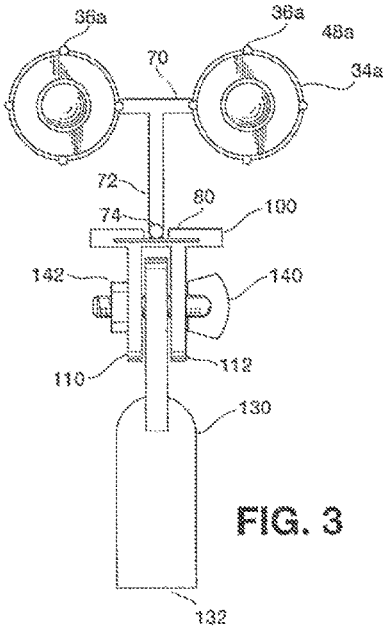
FIG. 3 is a top view of the FIG. 2 embodiment without a roller sleeve.
Figure 4:
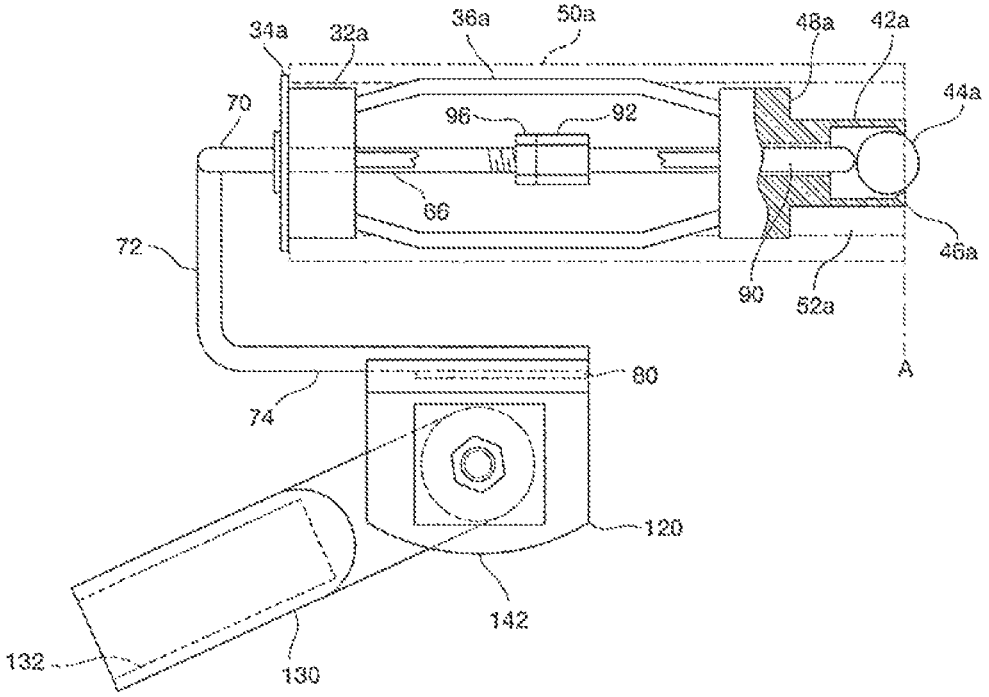
FIG. 4 is a side view of the FIG. 2 embodiment.

Further, the bracket arrangement illustrated in figures such as FIG. 2, and more particularly, in FIGS. 9 to 16, is an arrangement for particular use with the dual or double paint roller embodiment with an extension pole. The simplicity and originality of the construction of the bracket arrangement allows for a quick swap with another set of dual paint rollers when painting multiple colours. The bracket arrangement is new and original specifically for use with the dual or double roller embodiment.

The scope of the claims should not be limited by the preferred embodiments set forth in the description, but should be given the broadest interpretation consistent with the description as a whole.

What is claimed is:

1. A paint roller device for use with a paint roller sleeve comprising:

an inner hub and an outer hub axially spaced by a cage of wires and adapted for supporting the paint roller sleeve, the paint roller sleeve having an axial length greater than a length of the paint roller device and having a sleeve portion extending outwardly of an outer end of the outer hub when installed on the paint roller device;

a cylindrical retainer extending axially outwardly from the outer end of the outer hub and having an outer periphery with a diameter less than a diameter of the outer hub;

an open annulus around the cylindrical retainer, the open annulus defined by an inside surface of the outwardly extending sleeve portion when the paint roller sleeve is on the paint roller device, the outer end of the outer hub and the outer periphery of the cylindrical retainer, the open annulus being open at a distal end of the paint roller device to receive excess paint from the paint roller sleeve thereby impeding transference of the excess paint to the cylindrical retainer;

a ball partially retained within the cylindrical retainer with at least a portion of the ball extending axially outwardly by a predetermined distance from a plane defined by a distal end of the paint roller sleeve, the plane being perpendicular to an axis of rotation of the paint roller device, wherein the ball acts to guide the paint roller device against an adjacent surface.

2. The paint roller device of claim 1 wherein the distance of the ball outwardly of the plane is adjustable.

3. The paint roller device of claim 1 wherein an outer end of the cylindrical retainer has a flange to retain the ball such that the ball is rotatable therein.

4. The paint roller device of claim 2 wherein the outer hub has an axial bore therethrough, the paint roller device further comprising an axially central rod extending from the inner hub to the outer hub and an outer end of the central rod extending into and through the axial bore and in contact with the ball.

5. The paint roller device of claim 4 wherein the outer end of the central rod in contact with the ball is rounded.

6. The paint roller device of claim 5 wherein the central rod comprises an axially inner rod attached to the inner hub and an axially outer rod threadably connected to the axially inner rod, the outer rod being rotatable relative to the inner rod to adjust the predetermined distance of the ball.

7. The paint roller device of claim 6 wherein the ball is a glass ball.

8. The paint roller device of claim 1 further comprising a handle associated with and extending from the inner hub, the handle being angled from the axis of the paint roller device.

9. A dual paint roller device comprising two paint rollers supported side by side, at least one of the two paint rollers defined in accordance with claim 1.

10. The dual paint roller device of claim 9 wherein the at least one paint roller is defined in accordance with claim 2.

11. The dual paint roller device of claim 9 wherein the at least one paint roller is defined in accordance with claim 3.

12. The dual paint roller device of claim 9 wherein the at least one paint roller is defined in accordance with claim 4.

13. The dual paint roller device of claim 9 wherein the at least one paint roller is defined in accordance with claim 5.

14. The dual paint roller device of claim 9 wherein the at least one paint roller is defined in accordance with claim 6.

15. The dual paint roller device of claim 9 wherein the at least one paint roller is defined in accordance with claim 7.

16. The dual paint roller device of claim 9 wherein the paint rollers are supported laterally spaced in parallel to each other by a bracket support, said bracket support connected to a handle by an adjustable connection.

17. The dual paint roller device of claim 16 wherein the adjustable connection is adapted for adjusting the angle of the handle to a plane of the two rollers.

18. The dual paint roller device of claim 17 further wherein the adjustable connection is configured to also permit the dual rollers and the bracket support to be separated from the handle for cleaning the rollers or changing rollers with a different color.

* * * * *